US011176887B2

(12) United States Patent
Seo et al.

(10) Patent No.: US 11,176,887 B2
(45) Date of Patent: Nov. 16, 2021

(54) DISPLAY APPARATUS AND METHOD OF DRIVING THE SAME

(71) Applicant: Samsung Display Co., Ltd., Yongin-Si (KR)

(72) Inventors: Jung Deok Seo, Cheonan-si (KR); Seung-Kyu Lee, Asan-si (KR); Min Seong Son, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/892,130

(22) Filed: Jun. 3, 2020

(65) Prior Publication Data

US 2021/0110772 A1 Apr. 15, 2021

(30) Foreign Application Priority Data

Oct. 10, 2019 (KR) ..... 10-2019-0125595

(51) Int. Cl.
*G09G 3/3258* (2016.01)

(52) U.S. Cl.
CPC ..... *G09G 3/3258* (2013.01); *G09G 2310/06* (2013.01); *G09G 2320/0252* (2013.01); *G09G 2330/027* (2013.01)

(58) Field of Classification Search
CPC ..... G09G 3/3233; G09G 3/3258; G09G 2310/06; G09G 2320/0252; G09G 2330/021; G09G 2330/027; G09G 2330/028
USPC ..... 345/208
See application file for complete search history.

(56) References Cited

U.S. PATENT DOCUMENTS

| | | | | |
|---|---|---|---|---|
| 7,656,720 | B2 * | 2/2010 | Ito | G11C 5/144 365/189.09 |
| 2016/0260378 | A1 * | 9/2016 | Tsuge | G09G 3/3233 |
| 2016/0307505 | A1 * | 10/2016 | Tsuge | G09G 3/325 |
| 2017/0039955 | A1 * | 2/2017 | Park | G09G 3/3233 |
| 2019/0074340 | A1 * | 3/2019 | Cai | G09G 3/3266 |
| 2020/0043411 | A1 * | 2/2020 | Tsuge | G09G 3/3283 |
| 2020/0243008 | A1 * | 7/2020 | Lee | G09G 3/3275 |

FOREIGN PATENT DOCUMENTS

KR 10-2017-0065060 A 6/2017

* cited by examiner

*Primary Examiner* — Tom V Sheng
(74) *Attorney, Agent, or Firm* — Innovation Counsel LLP

(57) ABSTRACT

The present disclosure relates to a display apparatus enhancing a display quality and a method of driving the display apparatus. The display apparatus comprises a display panel and a power voltage generator. The display panel comprises a plurality of pixels. The power voltage generator is configured to output a first initialization voltage, a second initialization voltage, a first power voltage, and a second power voltage less than the first power voltage to the plurality of pixels. The power voltage generator is configured to output the second initialization voltage substantially equal to the second power voltage in response to an emergency shutdown signal.

17 Claims, 7 Drawing Sheets

DISPLAY APPARATUS AND METHOD OF DRIVING THE SAME

PRIORITY STATEMENT

This application claims priority under 35 U.S.C. § 119 to Korean Patent Application No. 10-2019-0125595, filed on Oct. 10, 2019 in the Korean Intellectual Property Office KIPO, the contents of which are herein incorporated by reference in their entireties.

BACKGROUND

1. Field

The present disclosure relates to a display apparatus and a method of driving the display apparatus. More particularly, the present disclosure relates to a display apparatus enhancing a display quality and a method of driving the display apparatus.

2. Description of the Related Art

Generally, a display apparatus may include a display panel and a display panel driver. The display panel may include a plurality of gate lines, a plurality of data lines, a plurality of emission lines and a plurality of pixels. The display panel driver may include a gate driver, a data driver, an emission driver, a driving controller and a power voltage generator. The gate driver may output gate signals to the gate lines. The data driver may output data voltages to the data lines. The emission driver may output emission signals to the emission lines. The driving controller may control the gate driver, the data driver and the emission driver. The power voltage generator may provide a power voltage to the display panel.

Generally, when the display apparatus receives an emergency shutdown signal, the power voltage may be blocked and the display panel may not display an image. Particularly, in an emergency shutdown mode, the pixel of the display panel may emit the light according to the level of the power voltage so that an undesired display defect may be generated. Thus, there is need to improve display quality by preventing a display defect in an emergency shutdown mode.

SUMMARY

Example embodiments of the present disclosure provide a display apparatus preventing a display defect in an emergency shutdown mode to enhance a display quality.

Example embodiments of the present disclosure also provide a method of driving the display apparatus.

In an example embodiment of a display apparatus according to the present disclosure, the display apparatus includes a display panel and a power voltage generator. The display panel includes a plurality of pixels. The power voltage generator is configured to output a first initialization voltage, a second initialization voltage, a first power voltage, and a second power voltage which is less than the first power voltage to the plurality of pixels. The power voltage generator is configured to output the second initialization voltage substantially equal to the second power voltage in response to an emergency shutdown signal.

In an example embodiment, the power voltage generator may include a first voltage generator configured to generate the second initialization voltage, a second voltage generator configured to generate the second power voltage, a first switch disposed between the first voltage generator, a first output terminal configured to output the second initialization voltage, and a second switch disposed between the first output terminal and a second output terminal which is configured to output the second power voltage.

In an example embodiment, the first switch may be configured to be turned on, and the second switch may be configured to be turned off in a normal mode when the emergency shutdown signal is inactivated.

In an example embodiment, the first switch may be configured to be turned off, and the second switch may be configured to be turned on in an emergency shutdown mode when the emergency shutdown signal is activated.

In an example embodiment, the power voltage generator may be configured to output the first initialization voltage substantially equal to the first power voltage in response to the emergency shutdown signal.

In an example embodiment, the power voltage generator may further include a third voltage generator configured to generate the first initialization voltage, a fourth voltage generator configured to generate the first power voltage, a third switch disposed between the third voltage generator, a third output terminal configured to output the first initialization voltage, and a fourth switch disposed between the third output terminal and a fourth output terminal which is configured to output the first power voltage.

In an example embodiment, the third switch may be configured to be turned on, and the fourth switch is configured to be turned off in a normal mode when the emergency shutdown signal is inactivated.

In an example embodiment, the third switch may be configured to be turned off, and the fourth switch is configured to be turned on in an emergency shutdown mode when the emergency shutdown signal is activated.

In an example embodiment, at least one of the pixels may include a first pixel switching element comprising a control electrode connected to a first node, an input electrode connected to a second node N2 and an output electrode connected to a third node, a second pixel switching element comprising a control electrode to which a data write gate signal is applied, an input electrode to which the data voltage is applied and an output electrode connected to the second node, a third pixel switching element comprising a control electrode to which the data write gate signal is applied, an input electrode connected to the first node and an output electrode connected to the third node, a fourth pixel switching element comprising a control electrode to which a data initialization gate signal is applied, an input electrode to which the first initialization voltage is applied and an output electrode connected to the first node, a fifth pixel switching element comprising a control electrode to which an emission signal is applied, an input electrode to which the first power voltage is applied and an output electrode connected to the second node, a sixth pixel switching element comprising a control electrode to which the emission signal is applied, an input electrode connected to the third node and an output electrode connected to an anode electrode of an organic light emitting element, a seventh pixel switching element comprising a control electrode to which the organic light emitting element initialization gate signal is applied, an input electrode to which the second initialization voltage is applied and an output electrode connected to the anode electrode of the organic light emitting element, a storage capacitor comprising a first electrode to which the first power voltage is applied and a second electrode connected to the first node and the organic light emitting element comprising the anode electrode and a cathode electrode to which the second power voltage is applied.

In an example embodiment, the control electrode of the seventh pixel switching element may be connected to the control electrode of the second pixel switching element.

In an example embodiment, the display apparatus may further include a driving controller configured to receive the emergency shutdown signal and to transmit the emergency shutdown signal to the power voltage generator.

In an example embodiment of a display apparatus according to the present disclosure, the display apparatus includes a display panel and a power voltage generator. The display panel includes a plurality of pixels. The power voltage generator is configured to output a first initialization voltage, a second initialization voltage, a first power voltage, a second power voltage which is less than the first power voltage. The power voltage generator is configured to output the first initialization voltage substantially equal to the first power voltage.

In an example embodiment, the power voltage generator may include a first voltage generator configured to generate the first initialization voltage, a second voltage generator configured to generate the first power voltage, a first switch disposed between the first voltage generator, a first output terminal configured to output the first initialization voltage, and a second switch disposed between the first output terminal and a second output terminal which is configured to output the first power voltage.

In an example embodiment, the first switch may be configured to be turned on, and the second switch may be configured to be turned off in a normal mode when the emergency shutdown signal is inactivated.

In an example embodiment, the first switch may be configured to be turned off, and the second switch may be configured to be turned on in an emergency shutdown mode when the emergency shutdown signal is activated.

In an example embodiment of a method of driving a display panel, the method includes outputting a first initialization voltage to pixels of a display panel, outputting a second initialization voltage to the pixels, outputting a first power voltage to the pixels and outputting a second power voltage less than the first power voltage to the pixels. The second initialization voltage substantially equal to the second power voltage is output to the pixels in response to an emergency shutdown signal.

In an example embodiment, a power voltage generator configured to output the first initialization voltage, the second initialization voltage, the first power voltage and the second power voltage to the pixels may include a first voltage generator configured to generate the second initialization voltage, a second voltage generator configured to generate the second power voltage, a first switch disposed between the first voltage generator and a first output terminal configured to output the second initialization voltage, and a second switch disposed between the first output terminal and a second output terminal configured to output the second power voltage.

In an example embodiment, the first switch may be configured to be turned on, and the second switch may be configured to be turned off in a normal mode when the emergency shutdown signal is inactivated.

In an example embodiment, the first switch may be configured to be turned off, and the second switch may be configured to be turned on in an emergency shutdown mode when the emergency shutdown signal is activated.

In an example embodiment, the power voltage generator may be configured to output the first initialization voltage substantially equal to the first power voltage in response to the emergency shutdown signal. The power voltage generator may further include a third voltage generator configured to generate the first initialization voltage, a fourth voltage generator configured to generate the first power voltage, a third switch disposed between the third voltage generator and a third output terminal configured to output the first initialization voltage, and a fourth switch disposed between the third output terminal and a fourth output terminal configured to output the first power voltage.

According to the display apparatus and the method of driving the display apparatus, when the power voltage generator receives the emergency shutdown signal having the active level, the power voltage generator may output the second initialization voltage substantially equal to the second power voltage so that the pixel of the display panel may not emit the light. In addition, when the power voltage generator receives the emergency shutdown signal having the active level, the power voltage generator may output the first initialization voltage substantially equal to the first power voltage so that the pixel of the display panel may not emit the light. Thus, the display quality of the display panel may be enhanced in the emergency shutdown mode.

BRIEF DESCRIPTION OF THE DRAWINGS

The above and other features and advantages of the present disclosure will become more apparent by describing in detailed example embodiments thereof with reference to the accompanying drawings, in which.

DETAILED DESCRIPTION

Hereinafter, the present disclosure will be explained in detail with reference to the accompanying drawings.

Figure 1:
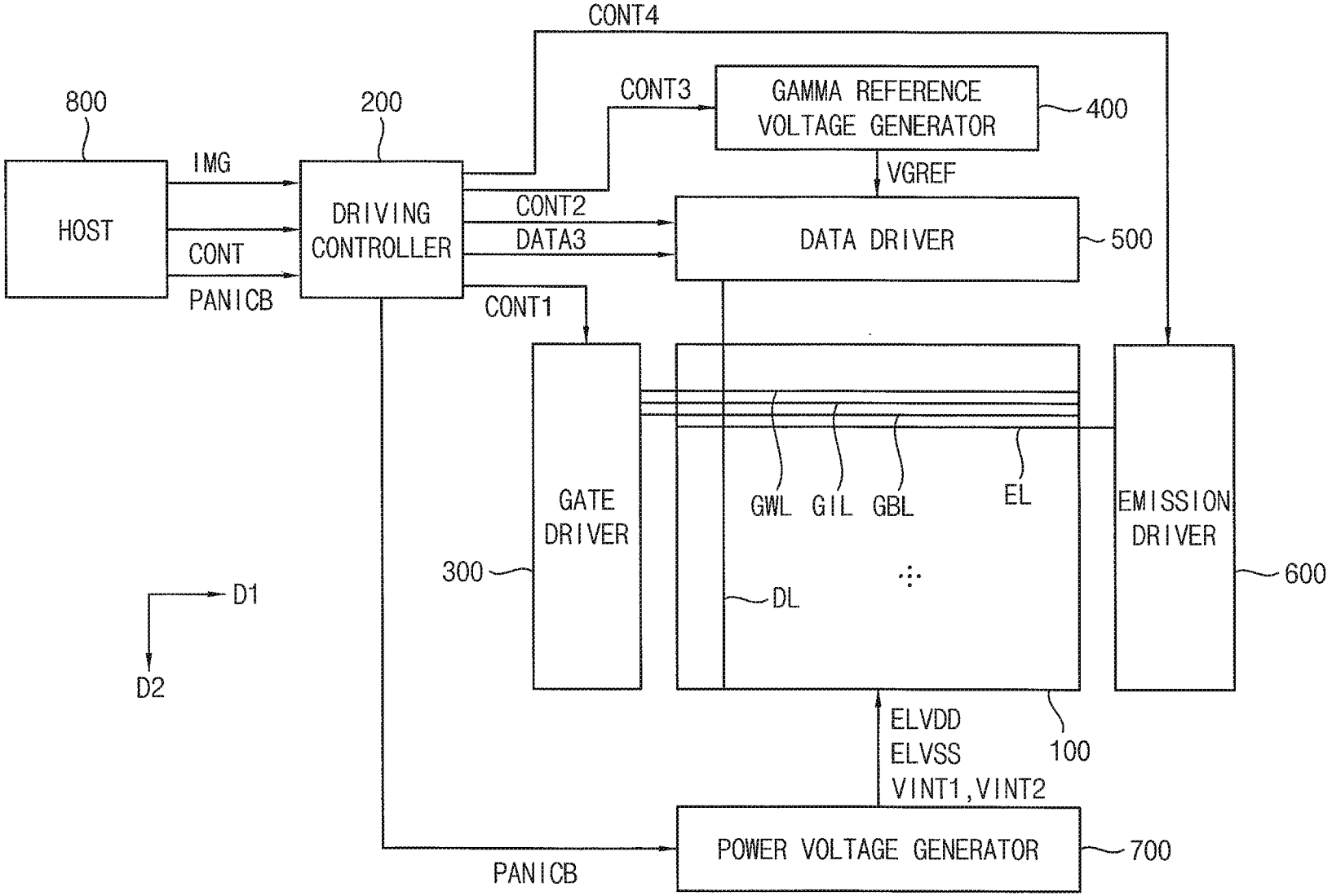
FIG. 1 is a block diagram illustrating a display apparatus according to an example embodiment of the present inventive concept.

FIG. 1 is a block diagram illustrating a display apparatus according to an example embodiment of the present disclosure.

Referring to FIG. 1, the display apparatus includes a display panel 100 and a display panel driver. The display panel driver includes a driving controller 200, a gate driver 300, a gamma reference voltage generator 400, a data driver 500, an emission driver 600, and a power voltage generator 700. The display apparatus may further include a host 800.

The display panel 100 has a display region on which an image is displayed and a peripheral region adjacent to the display region.

The display panel 100 includes a plurality of gate lines GWL, GIL, and GBL, a plurality of data lines DL, a plurality of emission lines EL and a plurality of pixels electrically connected to the gate lines GWL, GIL, and GBL, the data lines DL, and the emission lines EL. The gate lines GWL, GIL and GBL extend in a first direction D1, the data lines DL extend in a second direction D2 substantially perpendicular to the first direction D1, and the emission lines EL extend in the first direction D1.

The driving controller 200 receives input image data IMG and an input control signal CONT from the host 800. For example, the input image data IMG may include red image data, green image data, and blue image data. The input image data IMG may include white image data. The input image data IMG may include magenta image data, cyan image data, and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4, and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The driving controller 200 generates the fourth control signal CONT4 for controlling an operation of the emission driver 600 based on the input control signal CONT, and outputs the fourth control signal CONT4 to the emission driver 600.

The driving controller 200 may further receive an emergency shutdown signal PANICB from the host 800. The driving controller 200 may transmit the emergency shutdown signal PANICB to the power voltage generator 700. Alternatively, the power voltage generator 700 may directly receive the emergency shutdown signal PANICB from the host 800.

The gate driver 300 generates gate signals driving the gate lines GWL, GIL, and GBL in response to the first control signal CONT1 received from the driving controller 200. The gate driver 300 may sequentially output the gate signals to the gate lines GWL, GIL, and GBL. For example, the gate driver 300 may be integrated on the display panel 100. For example, the gate driver 300 may be mounted on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may output power voltages to the display panel 100 in order to drive the display panel 100. For example, the power voltage generator 700 may output a first power voltage ELVDD and a second power voltage less than the first power voltage ELVDD to the display panel 100. For example, the power voltage generator 700 may output a first initialization voltage VINT1 and a second initialization voltage VINT2 to the display panel 100.

The power voltage generator 700 may output a gate power voltage for driving the gate driver 300 to the gate driver 300. The power voltage generator 700 may output a data power voltage for driving the data driver 500 to the data driver 500. The power voltage generator 700 may output a digital power voltage for driving the driving controller 200 to the driving controller 200.

Figure 2:
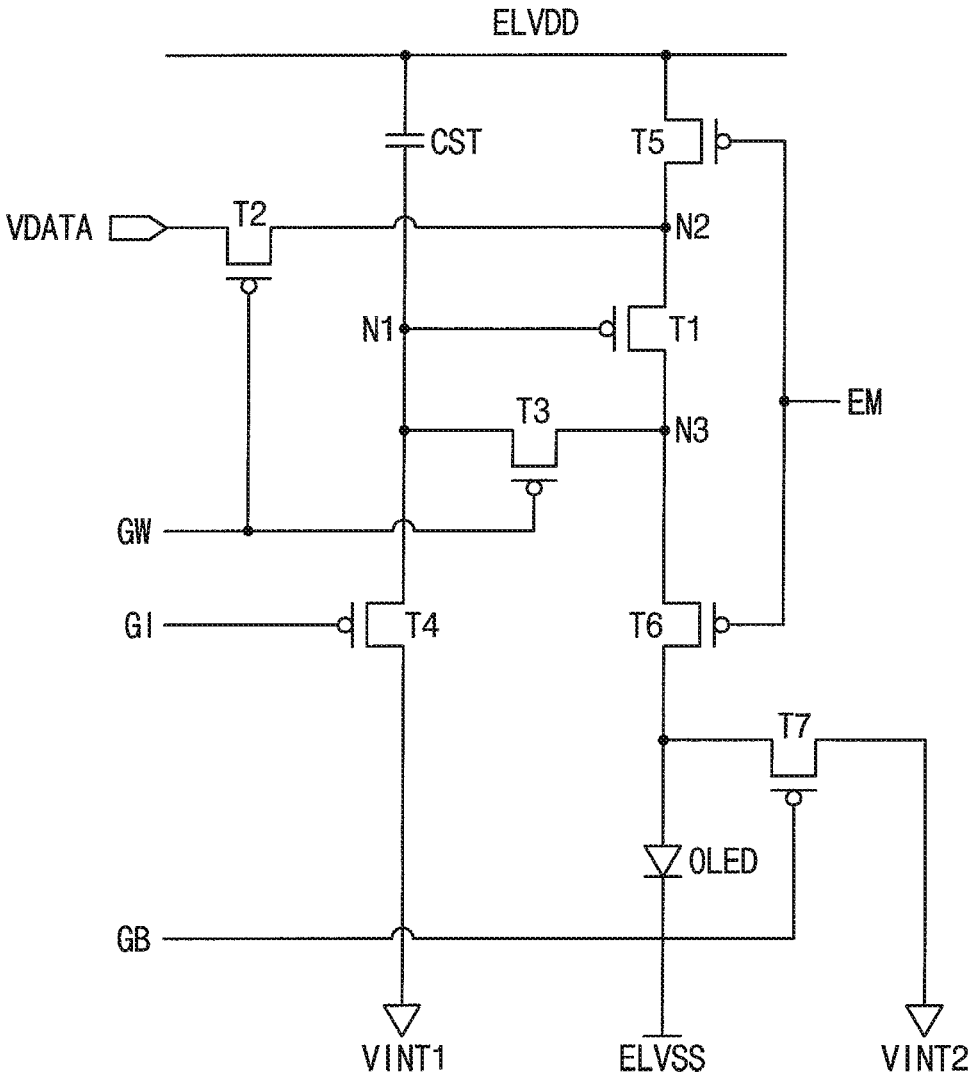
FIG. 2 is a circuit diagram illustrating a pixel of a display panel of FIG. 1.
Figure 3:
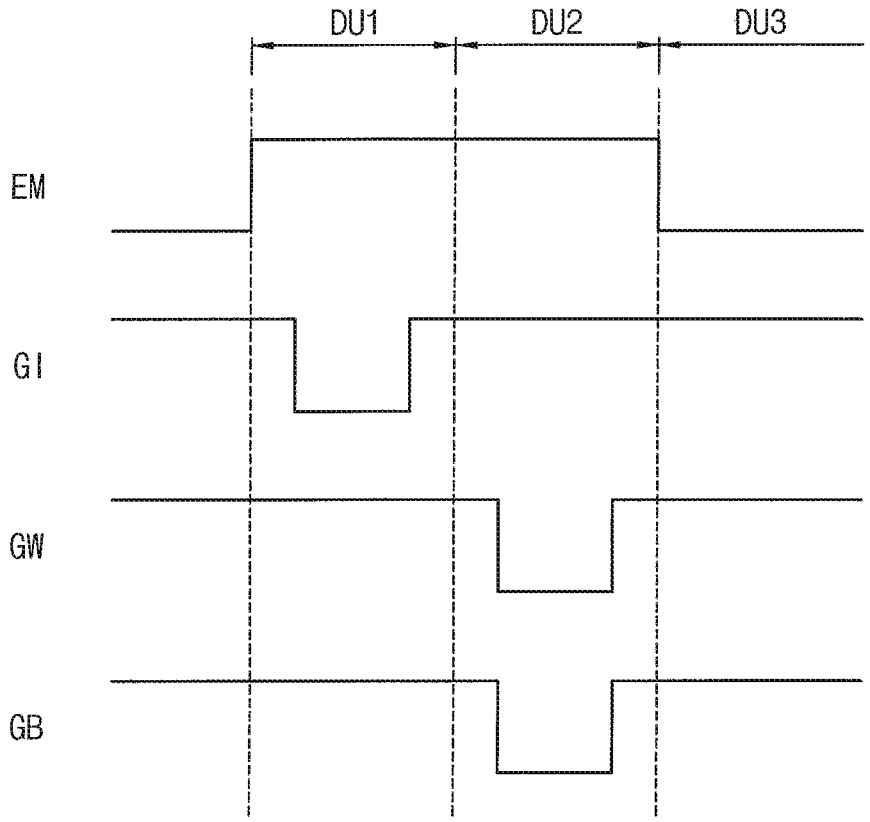
FIG. 3 is a timing diagram illustrating input signals applied to the pixel of FIG. 2.

FIG. 2 is a circuit diagram illustrating a pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

After the pixels receive a data write gate signal GW, a data initialization gate signal GI, an organic light emitting element initialization gate signal GB, the data voltage VDATA, and the emission signal EM, the organic light emitting elements OLED of the pixels emit light corresponding to the level of the data voltage VDATA to display the image.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2, and an output electrode connected to a third node N3.

The second pixel switching element T2 includes a control electrode to which the data write gate signal GW is applied, an input electrode to which the data voltage VDATA is applied, and an output electrode connected to the second node N2.

The third pixel switching element T3 includes a control electrode to which the data write gate signal GW is applied, an input electrode connected to the first node N1, and an output electrode connected to the third node N3.

The fourth pixel switching element T4 includes a control electrode to which the data initialization gate signal GI is applied, an input electrode to which the first initialization voltage VINT1 is applied, and an output electrode connected to the first node N1.

The fifth pixel switching element T5 includes a control electrode to which the emission signal EM is applied, an input electrode to which the first power voltage ELVDD is applied, and an output electrode connected to the second node N2.

The sixth pixel switching element T6 includes a control electrode to which the emission signal EM is applied, an input electrode connected to the third node N3, and an output electrode connected to an anode electrode of the organic light emitting element OLED.

The seventh pixel switching element T7 includes a control electrode to which the organic light emitting element initialization gate signal GB is applied, an input electrode to which the second initialization voltage VINT2 is applied, and an output electrode connected to the anode electrode of the organic light emitting element OLED.

For example, the first to seventh pixel switching elements T1 to T7 may be P-type thin film transistors. The control electrodes of the first to seventh pixel switching elements T1 to T7 may be gate electrodes. The input electrodes of the first to seventh pixel switching elements T1 to T7 may be source electrodes. The output electrodes of the first to seventh pixel switching elements T1 to T7 may be drain electrodes. For example, the first to seventh pixel switching elements T1 to T7 may be P-type polysilicon thin film transistors.

Alternatively, the first to seventh pixel switching elements T1 to T7 may be N-type thin film transistors. For example, the first to seventh pixel switching elements T1 to T7 may be N-type oxide thin film transistors.

Alternatively, some of the first to seventh pixel switching elements T1 to T7 may be P-type thin film transistors and some of the first to seventh pixel switching elements T1 to T7 may be N-type thin film transistors.

The storage capacitor CST includes a first electrode to which the first power voltage ELVDD is applied and a second electrode connected to the first node N1.

The organic light emitting element OLED includes the anode electrode and a cathode electrode to which a second power voltage ELVSS is applied.

In FIG. 3, during a first duration DU1, the first node N1 and the storage capacitor CST are initialized in response to the data initialization gate signal GI. During a second duration DU2, a threshold voltage |VTH| of the first pixel switching element T1 is compensated and the data voltage VDATA of which the threshold voltage |VTH| is compensated is written to the first node N1 in response to the data write gate signal GW. In addition, during the second duration DU2, the anode electrode of the organic light emitting element OLED is initialized in response to the organic light emitting element initialization gate signal GB. During a third duration DU3, the organic light emitting element OLED emits the light in response to the emission signal EM so that the display panel 100 displays the image.

During the first duration DU1, the data initialization gate signal GI may have an active level. For example, the active level of the data initialization gate signal GI may be a low level. When the data initialization gate signal GI has the active level, the fourth pixel switching element T4 is turned on so that the first initialization voltage VINT1 may be applied to the first node N1. The data initialization gate signal GI of a present stage may be a scan signal of a previous stage.

During the second duration DU2, the data write gate signal GW may have an active level. For example, the active level of the data write gate signal GW may be a low level. When the data write gate signal GW has the active level, the second pixel switching element T2 and the third pixel switching element T3 are turned on. In addition, the first pixel switching element T1 is turned on in response to the first initialization voltage VINT1. The data write gate signal GW of the present stage may be a scan signal SCAN of the present stage.

A voltage which is subtraction an absolute value |VTH| of the threshold voltage of the first pixel switching element T1 from the data voltage VDATA may be charged at the first node N1 along a path generated by the first to third pixel switching elements T1, T2, and T3.

In addition, during the second duration DU2, the organic light emitting element initialization gate signal GB may have an active level. For example, the active level of the organic light emitting element initialization gate signal GB may be a low level. When the organic light emitting element initialization gate signal GB has the active level, the seventh pixel switching element T7 is turned on so that the second initialization voltage VINT2 may be applied to the anode electrode of the organic light emitting element OLED. The organic light emitting element initialization gate signal GB of the present stage may be a scan signal SCAN of a next stage.

In the present example embodiment, the active duration of the organic light emitting element initialization gate signal GB may be substantially equal to the active duration of the data write gate signal GW. For example, the control electrode of the seventh pixel switching element T7 may be connected to the control electrode of the second pixel switching element T2.

During the third duration DU3, the emission signal EM may have an active level. The active level of the emission signal EM may be a low level. When the emission signal EM has the active level, the fifth pixel switching element T5 and the sixth pixel switching element T6 are turned on. In addition, the first pixel switching element T1 is turned on by the data voltage VDATA.

A driving current flows through the fifth pixel switching element T5, the first pixel switching element T1 and the sixth pixel switching element T6 to drive the organic light emitting element OLED. An intensity of the driving current may be determined by the level of the data voltage VDATA. A luminance of the organic light emitting element OLED is determined by the intensity of the driving current. The driving current ISD flowing through a path from the input electrode to the output electrode of the first pixel switching element T1 is determined as following Equation 1.

$$ISD = \frac{1}{2}\mu Cox\frac{W}{L}(VSG - |VTH|)^2 \quad \text{[Equation 1]}$$

In Equation 1, μ is a mobility of the first pixel switching element T1. Cox is a capacitance per unit area of the first pixel switching element T1. W/L is a width to length ratio of the first pixel switching element T1. VSG is a voltage between the input electrode N2 of the first pixel switching element T1 and the control node N1 of the first pixel switching element T1. |VTH| is the threshold voltage of the first pixel switching element T1.

The voltage VG of the first node N1 after the compensation of the threshold voltage |VTH| during the second duration DU2 may be represented as following Equation 2.

$$VG = VDATA - |VTH| \quad \text{[Equation 2]}$$

When the organic light emitting element OLED emits the light during the third duration DU3, the driving voltage VOV and the driving current ISD may be represented as following Equations 3 and 4. In Equation 3, VS is a voltage of the second node N2.

$$VOV = VS - VG - |VTH| = ELVDD - (VDATA - |VTH|) - |VTH| = ELVDD - VDATA \quad \text{[Equation 3]}$$

$$ISD = \frac{1}{2}\mu Cox\frac{W}{L}(ELVDD - VDATA)^2 \quad \text{[Equation 4]}$$

The threshold voltage |VTH| is compensated during the second duration DU2, so that the driving current ISD may be determined regardless of the threshold voltage |VTH| of the first pixel switching element T1 when the organic light emitting element OLED emits the light during the third duration DU3.

Figure 4:
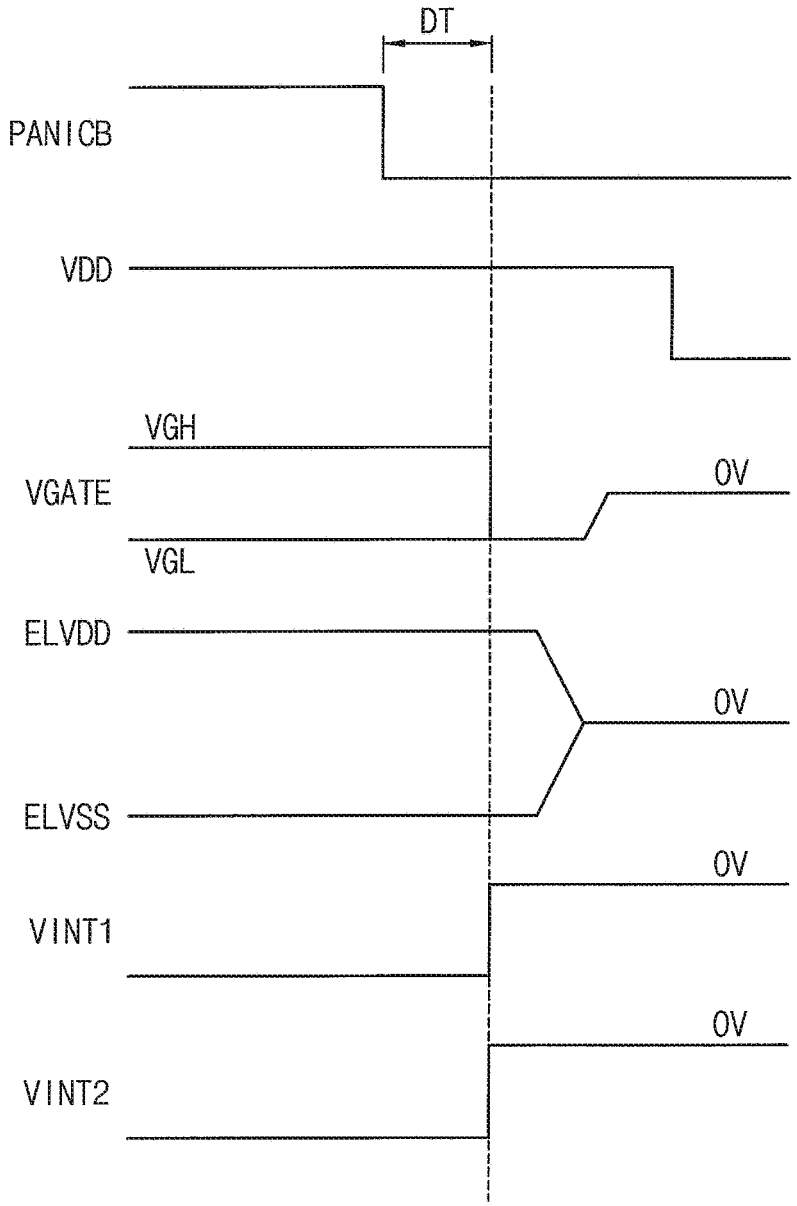
FIG. 4 is a timing diagram illustrating an output voltage of a power voltage generator of FIG. 1 in an emergency shutdown mode.
Figure 5:
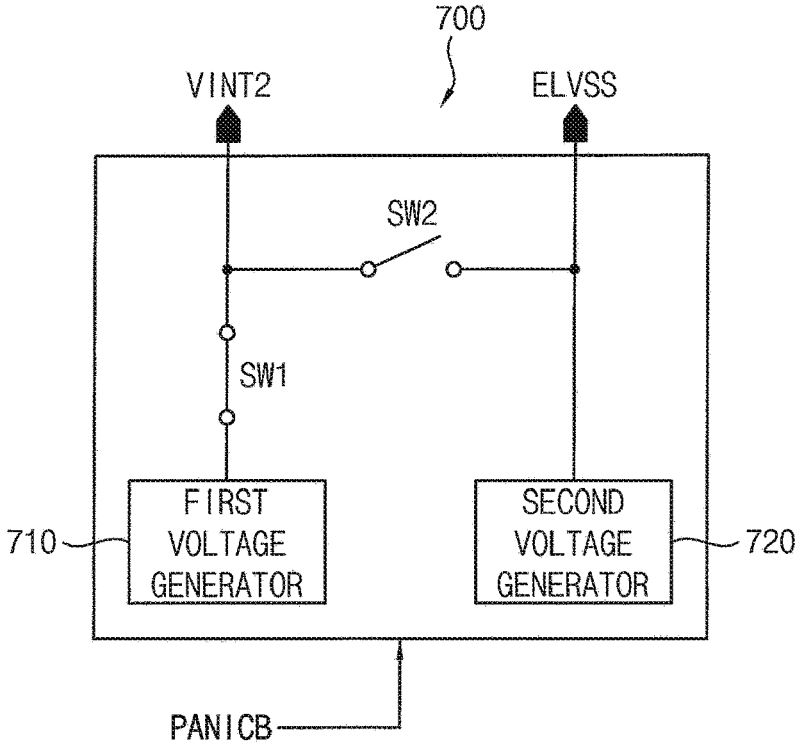
FIG. 5 is a block diagram illustrating an operation of the power voltage generator of FIG. 1 in a normal mode.
Figure 6:
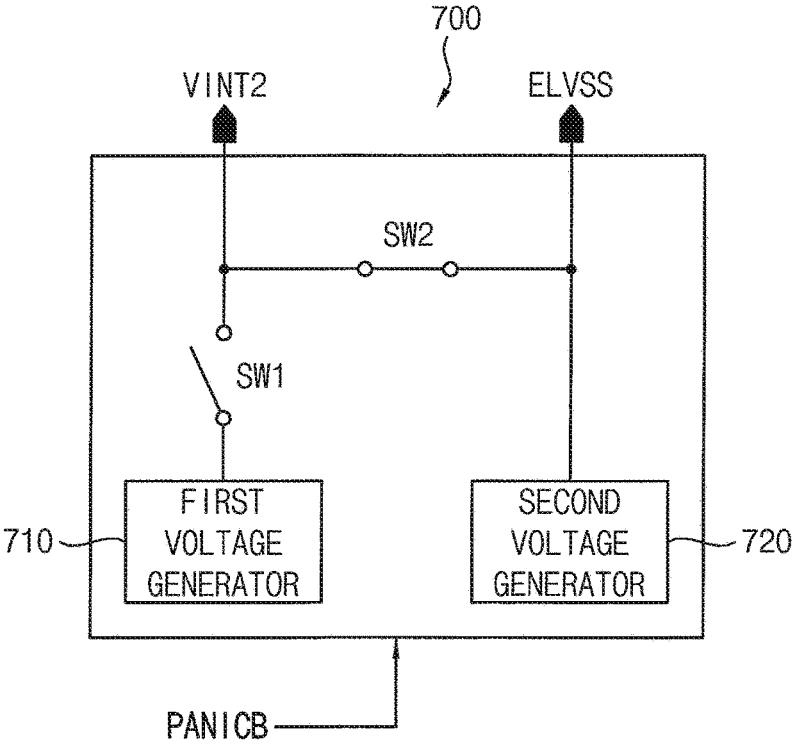
FIG. 6 is a block diagram illustrating an operation of the power voltage generator of FIG. 1 in the emergency shutdown mode.

FIG. 4 is a timing diagram illustrating an output voltage of the power voltage generator 700 of FIG. 1 in an emergency shutdown mode. FIG. 5 is a block diagram illustrating an operation of the power voltage generator 700 of FIG. 1 in a normal mode. FIG. 6 is a block diagram illustrating an operation of the power voltage generator 700 of FIG. 1 in the emergency shutdown mode.

Referring to FIGS. 1 to 6, the display apparatus may be operated in the normal mode and in the emergency shutdown mode. In the emergency shutdown mode, the display apparatus may be emergently turned off. The emergency shutdown mode may be determined by the emergency shutdown signal PANICB. The emergency shutdown signal PANICB may be inputted from the host 800 to the driving controller 200 or the power voltage generator 700.

After a predetermined determining time DT from activation of the emergency shutdown signal PANICB, the display apparatus may be operated in the emergency shutdown mode. Although the active level of the emergency shutdown signal PANICB is a low level in FIG. 4, the present disclosure may not be limited. For example, the predetermined determining time DT may be one frame.

In the emergency shutdown mode, the power voltage generator 700 may not generate the data power voltage VDD for driving the data driver 500, the gate power voltage VGATE for driving the gate driver 300, the first power voltage ELVDD, the second power voltage ELVSS, the first initialization voltage VINT1 and the second initialization voltage VINT2 output to the display panel 100.

FIG. 4 represents a sequence of stopping generation of the output voltages of the power voltage generator 700. After the predetermined determining time DT from activation of the emergency shutdown signal PANICB, the emergency shutdown mode starts. When the emergency shutdown mode starts, a gate high voltage VGH of the gate power voltage VGATE changes to a level of a gate low voltage VGL, and the first initialization voltage VINT1 and the second initialization voltage VINT2 change to 0V. After the first initialization voltage VINT1 and the second initialization voltage VINT2 change to 0V, the gate high voltage VGH and the gate low voltage VGL change to 0V.

A load connected to the first power voltage ELVDD and the second power voltage ELVSS is greater than a load connected to the first initialization voltage VINT1 and the second initialization voltage VINT2 so that levels of the first power voltage ELVDD and the second power voltage ELVSS are slowly changed compared to levels of the first initialization voltage VINT1 and the second initialization voltage VINT2.

When the emergency shutdown mode starts, the second initialization voltage VINT2 may be immediately changed to 0V and the second power voltage ELVSS may be gradually changed to 0V so that the second initialization voltage VINT2 may be greater than the second power voltage ELVSS temporarily.

In a duration where the second initialization voltage VINT2 is greater than the second power voltage ELVSS, the seventh pixel switching element T7 may be turned on so that a part of the display panel 100 may undesirably emit the light.

As depicted in FIG. 5 and FIG. 6, the power voltage generator 700 may include a first voltage generator 710 for generating the second initialization voltage VINT2 and a second voltage generator 720 for generating the second power voltage ELVSS, a first switch SW1 disposed between the first voltage generator 710, a first output terminal outputting the second initialization voltage VINT2, a second switch SW2 disposed between the first output terminal, and a second output terminal outputting the second power voltage ELVSS.

In the normal mode, when the emergency shutdown signal PANICB is inactivated, the first switch SW1 may be turned on and the second switch SW2 may be turned off. Thus, the second output terminal may output the second power voltage ELVSS and the first output terminal may output the second initialization voltage VINT2 which is independent from the second power voltage ELVSS in the normal mode.

In contrast, in the emergency shutdown mode, when the emergency shutdown signal PANICB is activated, the first switch SW1 may be turned off and the second switch SW2 may be turned on. Thus, the second output terminal may output the second power voltage ELVSS and the first output terminal may output the second initialization voltage VINT2 substantially equal to the second power voltage ELVSS in the emergency shutdown mode.

In the emergency shutdown mode, the second initialization voltage VINT2 is substantially equal to the second power voltage ELVSS so that the seventh pixel switching element T7 may not be undesirably turned on so that a part of the display panel 100 may not undesirably emit the light.

According to the present example embodiment, when the power voltage generator 700 receives the emergency shutdown signal having the active level, the power voltage generator 700 may output the second initialization voltage VINT2 substantially equal to the second power voltage ELVSS so that the pixel of the display panel 100 may not emit the light. Thus, the display quality of the display panel 100 may be enhanced in the emergency shutdown mode.

Figure 7:
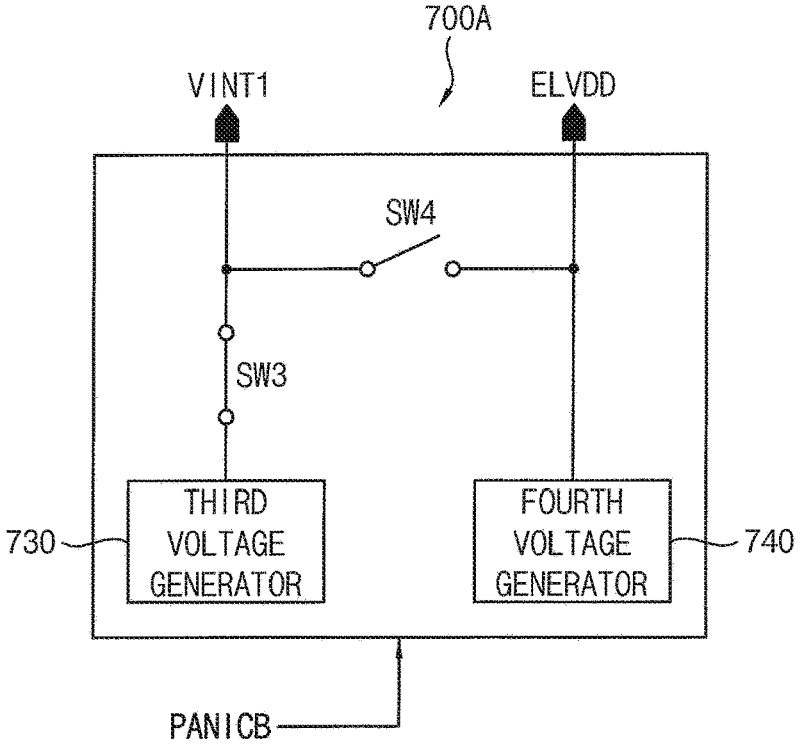
FIG. 7 is a block diagram illustrating an operation of a power voltage generator of a display apparatus according to an example embodiment of the present disclosure in a normal mode.
Figure 8:
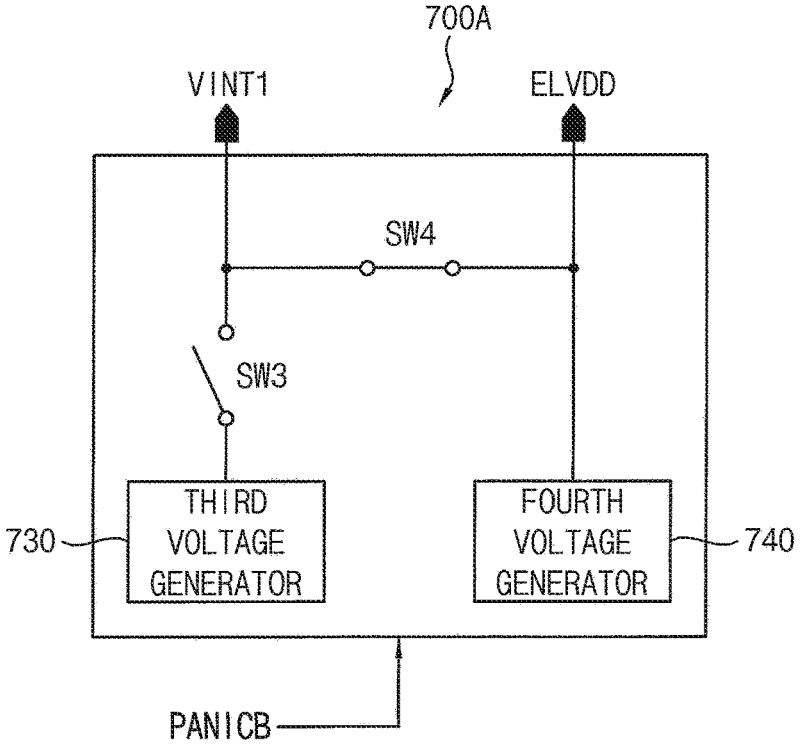
FIG. 8 is a block diagram illustrating an operation of the power voltage generator of FIG. 7 in the emergency shutdown mode.

FIG. 7 is a block diagram illustrating an operation of a power voltage generator 700A of a display apparatus according to an example embodiment of the present disclosure in a normal mode. FIG. 8 is a block diagram illustrating an operation of the power voltage generator 700A of FIG. 7 in an emergency shutdown mode.

The display apparatus and the method of driving the display apparatus according to the present example embodiment is substantially equal to the display apparatus and the method of driving the display apparatus of the previous example embodiment explained referring to FIGS. 1 to 6 except for the structure and the operation of the power voltage generator. Thus, the same reference numerals will be used to refer to the same or like parts as those described in the previous example embodiment of FIGS. 1 to 6 and any repetitive explanation concerning the above elements will be omitted.

Referring to FIGS. 1, 2, 3, 4, 7, and 8, the display apparatus includes a display panel 100 and a display panel driver. The display panel driver includes a driving controller 200, a gate driver 300, a gamma reference voltage generator 400, a data driver 500, an emission driver 600, and a power voltage generator 700A. The display apparatus may further include a host 800.

The display apparatus may be operated in the normal mode and in the emergency shutdown mode. In the emergency shutdown mode, the display apparatus may be emergently turned off. The emergency shutdown mode may be determined by an emergency shutdown signal PANICB. The emergency shutdown signal PANICB may be inputted from the host 800 to the driving controller 200 or the power voltage generator 700A.

As depicted in FIG. 4, after a predetermined determining time DT from activation of the emergency shutdown signal PANICB, the emergency shutdown mode starts. When the emergency shutdown mode starts, the first initialization voltage VINT1 may be immediately changed to 0V and the first power voltage ELVDD may be gradually changed to 0V so that the first pixel switching element T1 may be turned on due to the temporal difference between the first initialization voltage VINT1 and the first power voltage ELVDD. Thus, a part of the display panel 100 may undesirably emit the light.

As depicted in FIG. 7 and FIG. 8, the power voltage generator 700A may include a third voltage generator 730 generating the first initialization voltage VINT1, a fourth voltage generator 740 generating the first power voltage ELVDD, a third switch SW3 disposed between the third voltage generator 730 and a third output terminal outputting the first initialization voltage VINT1, a fourth switch SW4 disposed between the third output terminal, and a fourth output terminal outputting the first power voltage ELVDD.

In the normal mode, when the emergency shutdown signal PANICB is inactivated, the third switch SW3 may be turned on and the fourth switch SW4 may be turned off. Thus, the fourth output terminal may output the first power voltage ELVDD, and the third output terminal may output the first initialization voltage VINT1 which is independent from the first power voltage ELVDD in the normal mode.

In contrast, in the emergency shutdown mode, when the emergency shutdown signal PANICB is activated, the third switch SW3 may be turned off and the fourth switch SW4 may be turned on. Thus, the fourth output terminal may output the first power voltage ELVDD and the third output terminal may output the first initialization voltage VINT1 substantially equal to the first power voltage ELVDD in the emergency shutdown mode.

In the emergency shutdown mode, the first initialization voltage VINT1 is substantially equal to the first power voltage ELVDD so that the first pixel switching element T1 may not be undesirably turned on so that a part of the display panel 100 may not undesirably emit the light.

According to the present example embodiment, when the power voltage generator 700A receives the emergency shutdown signal having the active level, the power voltage generator 700A may output the first initialization voltage VINT1 substantially the same as the first power voltage ELVDD so that the pixel of the display panel 100 may not emit the light. Thus, the display quality of the display panel 100 may be enhanced in the emergency shutdown mode.

Figure 9:
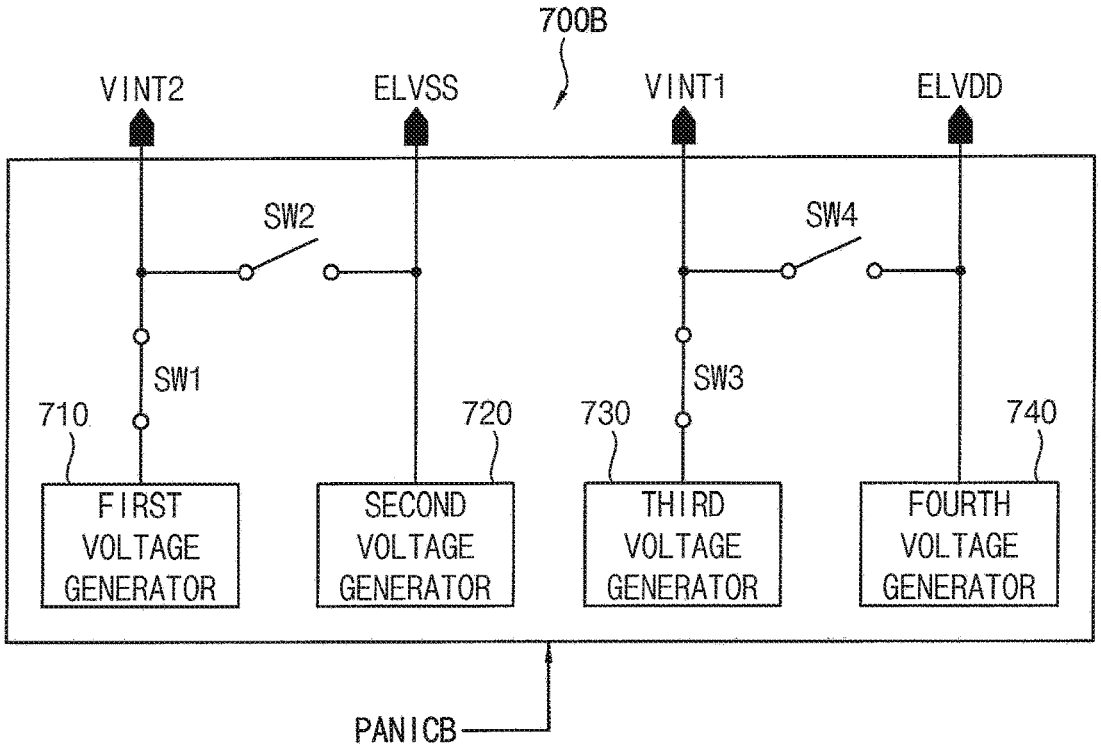
FIG. 9 is a block diagram illustrating an operation of a power voltage generator of a display apparatus according to an example embodiment of the present disclosure in a normal mode.

FIG. 9 is a block diagram illustrating an operation of a power voltage generator 700B of a display apparatus according to an example embodiment of the present disclosure in a normal mode. FIG. 8 is a block diagram illustrating an operation of the power voltage generator 700B of FIG. 7 in an emergency shutdown mode.

The display apparatus and the method of driving the display apparatus according to the present example embodiment is substantially equal to the display apparatus and the method of driving the display apparatus of the previous example embodiment explained referring to FIGS. 1 to 6 except for the structure and the operation of the power voltage generator. Thus, the same reference numerals will be used to refer to the same or like parts as those described in the previous example embodiment of FIGS. 1 to 6 and any repetitive explanation concerning the above elements will be omitted.

Referring to FIGS. 1, 2, 3, 4, 9, and 10, the display apparatus includes a display panel 100 and a display panel driver. The display panel driver includes a driving controller 200, a gate driver 300, a gamma reference voltage generator 400, a data driver 500, an emission driver 600, and a power voltage generator 700B. The display apparatus may further include a host 800.

The display apparatus may be operated in the normal mode and in the emergency shutdown mode. In the emergency shutdown mode, the display apparatus may be emergently turned off. The emergency shutdown mode may be determined by an emergency shutdown signal PANICB. The emergency shutdown signal PANICB may be inputted from the host 800 to the driving controller 200 or the power voltage generator 700B.

As depicted in FIG. 4, after a predetermined determining time DT from activation of the emergency shutdown signal PANICB, the emergency shutdown mode starts. When the emergency shutdown mode starts, the second initialization voltage VINT2 may be immediately changed to 0V and the second power voltage ELVSS may be gradually changed to 0V so that the seventh pixel switching element T7 may be turned on due to the temporal difference between the second initialization voltage VINT2 and the second power voltage ELVSS. Thus, a part of the display panel 100 may undesirably emit the light.

In addition, when the emergency shutdown mode starts, the first initialization voltage VINT1 may be immediately changed to 0V and the first power voltage ELVDD may be gradually changed to 0V so that the first pixel switching element T1 may be turned on due to the temporal difference between the first initialization voltage VINT1 and the first power voltage ELVDD. Thus, a part of the display panel 100 may undesirably emit the light.

Figure 10:
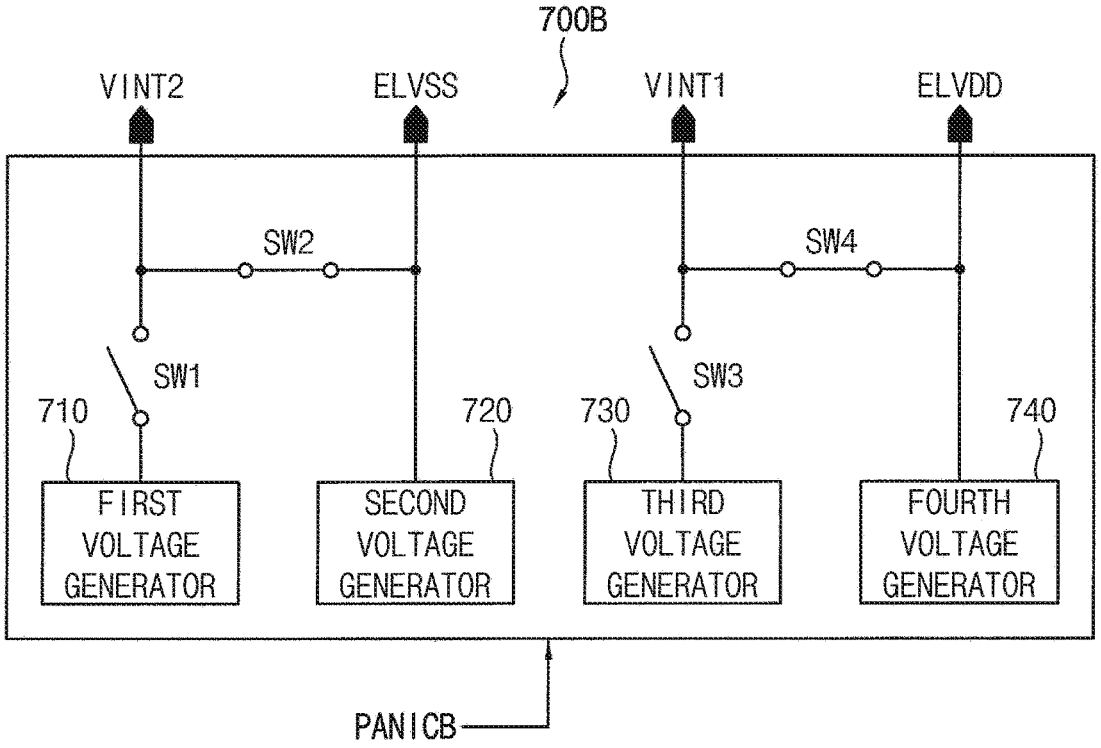
FIG. 10 is a block diagram illustrating an operation of the power voltage generator of FIG. 9 in the emergency shutdown mode.

As depicted in FIG. 9 and FIG. 10, the power voltage generator 700B may include a first voltage generator 710 generating the second initialization voltage VINT2, a second voltage generator 720 generating the second power voltage ELVSS, a first switch SW1 disposed between the first voltage generator 710 and a first output terminal outputting the second initialization voltage VINT2, a second switch SW2 disposed between the first output terminal, a second output terminal outputting the second power voltage ELVSS, a third voltage generator 730 generating the first initialization voltage VINT1, a fourth voltage generator 740 generating the first power voltage ELVDD, a third switch SW3 disposed between the third voltage generator 730 and a third output terminal outputting the first initialization voltage VINT1, and a fourth switch SW4 disposed between the third output terminal and a fourth output terminal outputting the first power voltage ELVDD In the normal mode, when the emergency shutdown signal PANICB is inactivated, the first switch SW1 may be turned on and the second switch SW2 may be turned off. Thus, the second output terminal may output the second power voltage ELVSS and the first output terminal may output the second initialization voltage VINT2 independent from the second power voltage ELVSS in the normal mode.

In contrast, in the emergency shutdown mode, when the emergency shutdown signal PANICB is activated, the first switch SW1 may be turned off and the second switch SW2 may be turned on. Thus, the second output terminal may output the second power voltage ELVSS and the first output terminal may output the second initialization voltage VINT2 substantially equal to the second power voltage ELVSS in the emergency shutdown mode.

In the emergency shutdown mode, the second initialization voltage VINT2 is substantially equal to the second power voltage ELVSS so that the seventh pixel switching element T7 may not be undesirably turned on so that a part of the display panel 100 may not undesirably emit the light.

In addition, in the normal mode when the emergency shutdown signal PANICB is inactivated, the third switch SW3 may be turned on and the fourth switch SW4 may be turned off. Thus, the fourth output terminal may output the first power voltage ELVDD and the third output terminal may output the first initialization voltage VINT1 which is independent from the first power voltage ELVDD in the normal mode.

In contrast, in the emergency shutdown mode, when the emergency shutdown signal PANICB is activated, the third switch SW3 may be turned off and the fourth switch SW4 may be turned on. Thus, the fourth output terminal may output the first power voltage ELVDD and the third output terminal may output the first initialization voltage VINT1 substantially equal to the first power voltage ELVDD in the emergency shutdown mode.

In the emergency shutdown mode, the first initialization voltage VINT1 is substantially equal to the first power voltage ELVDD so that the first pixel switching element T1 may not be undesirably turned on so that a part of the display panel 100 may not undesirably emit the light.

According to the present example embodiment, when the power voltage generator 700B receives the emergency shutdown signal having the active level, the power voltage generator 700B may output the second initialization voltage VINT2 substantially the same as the second power voltage ELVSS and the first initialization voltage VINT1 substantially equal to the first power voltage ELVDD so that the pixel of the display panel 100 may not emit the light. Thus, the display quality of the display panel 100 may be enhanced in the emergency shutdown mode.

According to the present disclosure as explained above, the display quality of the display panel may be enhanced in the emergency shutdown mode.

The foregoing is illustrative of the present disclosure and is not to be construed as limiting. Although a few example embodiments of the present disclosure have been described, those skilled in the art will readily appreciate that many modifications are possible in the example embodiments without materially departing from the novel teachings and advantages of the present disclosure. Accordingly, all such modifications are intended to be included within the scope of the present disclosure as defined in the claims. In the claims, means-plus-function clauses are intended to cover the structures described herein as performing the recited function and not only structural equivalents but also equivalent structures. Therefore, it is to be understood that the foregoing is illustrative of the present disclosure and is not to be construed as limited to the specific example embodiments disclosed, and that modifications to the disclosed example embodiments, as well as other example embodiments, are intended to be included within the scope of the appended claims. The present disclosure is defined by the following claims, with equivalents of the claims to be included.

What is claimed is:

1. A display apparatus comprising:

a display panel including a plurality of pixels; and a power voltage generator configured to output a first initialization voltage, a second initialization voltage, a first power voltage, and a second power voltage which is less than the first power voltage to the plurality of pixels, wherein the power voltage generator is configured to output the second initialization voltage substantially equal to the second power voltage in response to an emergency shutdown signal, wherein the power voltage generator comprises:

a first voltage generator configured to generate the second initialization voltage;

a second voltage generator configured to generate the second power voltage;

a first switch disposed between the first voltage generator and a first output terminal which is configured to output the second initialization voltage; and a second switch disposed between the first output terminal and a second output terminal which is configured to output the second power voltage.

2. The display apparatus of claim 1, wherein the first switch is configured to be turned on, and the second switch is configured to be turned off in a normal mode when the emergency shutdown signal is inactivated.

3. The display apparatus of claim 1, wherein the first switch is configured to be turned off, and the second switch is configured to be turned on in an emergency shutdown mode when the emergency shutdown signal is activated.

4. The display apparatus of claim 1, wherein the power voltage generator is configured to output the first initialization voltage substantially equal to the first power voltage in response to the emergency shutdown signal.

5. The display apparatus of claim 4, wherein the power voltage generator further comprises:

a third voltage generator configured to generate the first initialization voltage;

a fourth voltage generator configured to generate the first power voltage;

a third switch disposed between the third voltage generator and a third output terminal which is configured to output the first initialization voltage; and a fourth switch disposed between the third output terminal and a fourth output terminal which is configured to output the first power voltage.

6. The display apparatus of claim 5, wherein the third switch is configured to be turned on, and the fourth switch is configured to be turned off in a normal mode when the emergency shutdown signal is inactivated.

7. The display apparatus of claim 6, wherein the third switch is configured to be turned off, and the fourth switch is configured to be turned on in an emergency shutdown mode when the emergency shutdown signal is activated.

8. The display apparatus of claim 1, wherein at least one of the pixels comprises:

a first pixel switching element comprising a control electrode connected to a first node, an input electrode connected to a second node, and an output electrode connected to a third node;

a second pixel switching element comprising a control electrode to which a data write gate signal is applied, an input electrode to which the data voltage is applied, and an output electrode connected to the second node;

a third pixel switching element comprising a control electrode to which the data write gate signal is applied, an input electrode connected to the first node, and an output electrode connected to the third node;

a fourth pixel switching element comprising a control electrode to which a data initialization gate signal is applied, an input electrode to which the first initialization voltage is applied, and an output electrode connected to the first node;

a fifth pixel switching element comprising a control electrode to which an emission signal is applied, an input electrode to which the first power voltage is applied, and an output electrode connected to the second node;

a sixth pixel switching element comprising a control electrode to which the emission signal is applied, an input electrode connected to the third node, and an output electrode connected to an anode electrode of an organic light emitting element;

a seventh pixel switching element comprising a control electrode to which the organic light emitting element initialization gate signal is applied, an input electrode to which the second initialization voltage is applied, and an output electrode connected to the anode electrode of the organic light emitting element;

a storage capacitor comprising a first electrode to which the first power voltage is applied and a second electrode connected to the first node; and the organic light emitting element comprising the anode electrode and a cathode electrode to which the second power voltage is applied.

9. The display apparatus of claim 8, wherein the control electrode of the seventh pixel switching element is connected to the control electrode of the second pixel switching element.

10. The display apparatus of claim 1, further comprising a driving controller configured to receive the emergency shutdown signal and to transmit the emergency shutdown signal to the power voltage generator.

11. A display apparatus comprising:

a display panel comprising a plurality of pixels;

a power voltage generator configured to output a first initialization voltage, a second initialization voltage, a first power voltage, a second power voltage which is less than the first power voltage to the plurality of pixels, wherein the power voltage generator is configured to output the first initialization voltage substantially equal to the first power voltage in response to an emergency shutdown signal, wherein the power voltage generator comprises:

a first voltage generator configured to generate the first initialization voltage;

a second voltage generator configured to generate the first power voltage;

a first switch disposed between the first voltage generator and a first output terminal configured to output the first initialization voltage; and a second switch disposed between the first output terminal and a second output terminal which is configured to output the first power voltage.

12. The display apparatus of claim 11, wherein the first switch is configured to be turned on, and the second switch is configured to be turned off in a normal mode when the emergency shutdown signal is inactivated.

13. The display apparatus of claim 11, wherein the first switch is configured to be turned off, and the second switch is configured to be turned on in an emergency shutdown mode when the emergency shutdown signal is activated.

14. A method of driving a display apparatus, the method comprising:

outputting a first initialization voltage to a plurality of pixels of a display panel;

outputting a second initialization voltage to the plurality of pixels;

outputting a first power voltage to the plurality of pixels; and outputting a second power voltage which is less than the first power voltage to the pixels, wherein the second initialization voltage substantially equal to the second power voltage is output to the pixels in response to an emergency shutdown signal, wherein a power voltage generator configured to output the first initialization voltage, the second initialization voltage, the first power voltage, and the second power voltage to the plurality of pixels comprises:

a first voltage generator configured to generate the second initialization voltage;

a second voltage generator configured to generate the second power voltage;

a first switch disposed between the first voltage generator and a first output terminal which is configured to output the second initialization voltage; and a second switch disposed between the first output terminal and a second output terminal which is configured to output the second power voltage.

15. The method of claim 14, wherein the first switch is configured to be turned on, and the second switch is configured to be turned off in a normal mode when the emergency shutdown signal is inactivated.

16. The method of claim 14, wherein the first switch is configured to be turned off, and the second switch is configured to be turned on in an emergency shutdown mode when the emergency shutdown signal is activated.

17. The method of claim 14, wherein the first initialization voltage substantially equal to the first power voltage is output to the pixels in response to the emergency shutdown signal, and wherein the power voltage generator further comprises:

a third voltage generator configured to generate the first initialization voltage;

a fourth voltage generator configured to generate the first power voltage;

a third switch disposed between the third voltage generator and a third output terminal which is configured to output the first initialization voltage; and a fourth switch disposed between the third output terminal and a fourth output terminal which is configured to output the first power voltage.

* * * * *